United States Patent [19]

Day

[11] 4,075,774

[45] Feb. 28, 1978

[54] PERPETUAL CALENDAR

[76] Inventor: Bernard L. Day, 6300 Washington Ave., Erie, Pa. 16509

[21] Appl. No.: 692,723

[22] Filed: Jun. 4, 1976

[51] Int. Cl.[2] ..... G09D 3/10

[52] U.S. Cl. ..... 40/109

[58] Field of Search ..... 40/109, 107, 110, 65, 40/64 R, 62; 283/2–4

[56] References Cited

U.S. PATENT DOCUMENTS

| | | | |
|---|---|---|---|
| 1,373,744 | 4/1921 | Kelly | 40/109 |
| 2,499,329 | 2/1950 | Potter | 40/109 |

FOREIGN PATENT DOCUMENTS

| | | | |
|---|---|---|---|
| 381,353 | 10/1932 | United Kingdom | 40/109 |
| 602,604 | 5/1948 | United Kingdom | 40/107 |

*Primary Examiner*—John F. Pitrelli

*Attorney, Agent, or Firm*—Charles L. Lovercheck

[57] ABSTRACT

A calendar having a front sheet with holes arranged in seven vertical and six horizontal rows. Seven slides are provided, each slide is adapted to slide in one of said vertical rows. Each slide has numbers arranged in a vertical row on the front and another on the back. Each slide is supported behind one of said vertical rows of holes with the numbers on one side of said slide exposed through the holes. The slides can be arranged behind said vertical rows of holes with the numbers thereon exposed through the holes in the order of the days of the weeks and months of the year, for any year.

1 Claim, 10 Drawing Figures

PERPETUAL CALENDAR

REFERENCT TO PRIOR ART

The calendar disclosed herein is an improvement over the calendar shown in U.S. Pat. No. 3,242,602; 1,513,253; and 3,050,886; and 2,447,807.

OBJECTS OF THE INVENTION

It is an object of the invention to provide an improved calendar.

Another object of the invention is to provide an improved calendar that is simple in construction, economical to manufacture and simple and efficient to use.

Another object of the invention is to provide a simple and efficient perpetual calendar.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

DETAILED DESCRIPTION OF THE DRAWINGS

Figure 1:
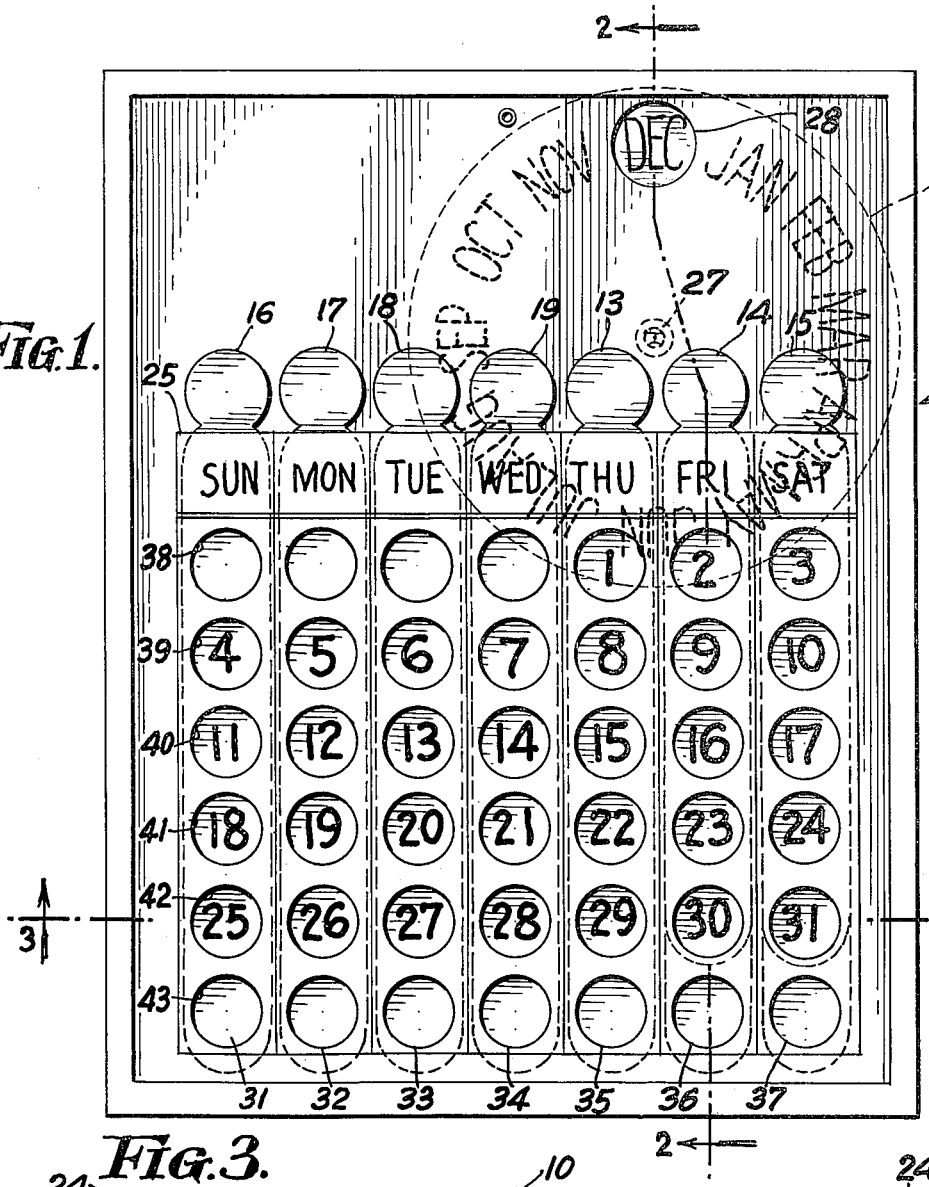
FIG. 1 is a front view of the calendar according to the invention.
Figure 2:
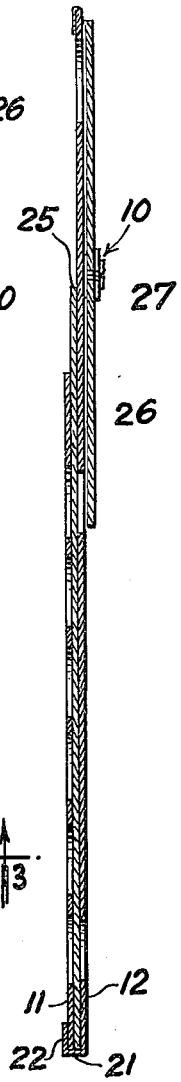
FIG. 2 is a cross-sectional view taken on line 2—2 of FIG. 1
Figure 3:
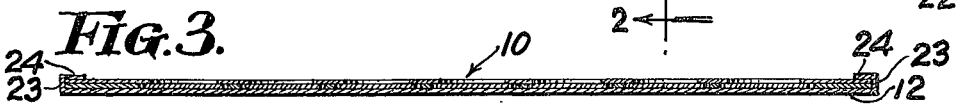
FIG. 3 is a cross-sectional view taken on line 3—3 of FIG. 1
Figures 4, 5, 6, 7, 8, 9, 10:
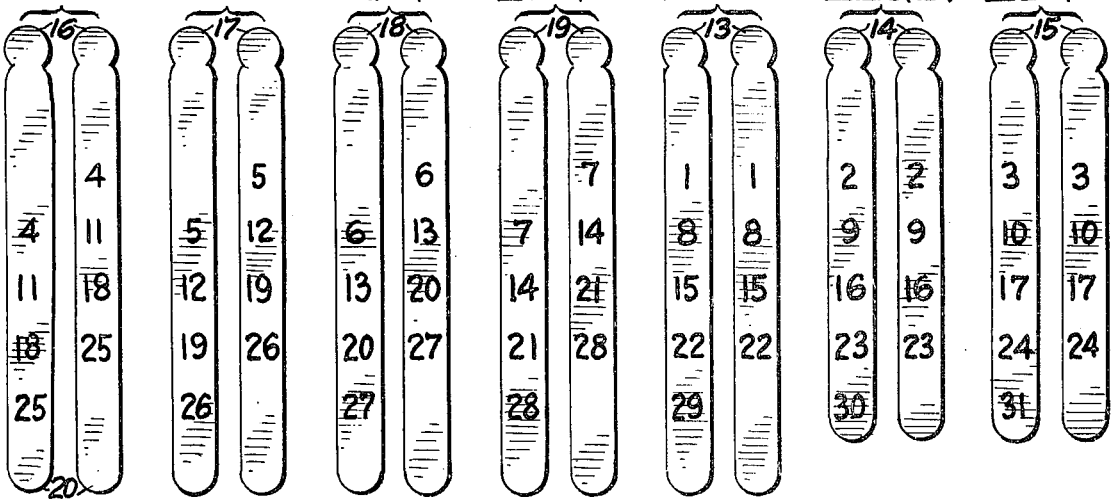
FIG. 4 is a composite view of the front and the back of one slide.
FIG. 5 is a view similar to FIG. 4 of the front and back of another slide.
FIG. 6 is a view similar to FIGS. 4 and 5 of another slide.
FIG. 7 is a view similar to FIGS. 4, 5 and 6 of the front and back of another slide.
FIG. 8 is a view similar to FIGS. 4, 5, 6 and 7 of the front and back of another slide.
FIG. 9 is a view similar to FIGS. 4, 5, 6 and 7 of the front and the back of another slide.
FIG. 10 is a view similar to FIGS. 4, 5, 6, 7 and 8 of the front and the back of another slide.

Now, with more particular reference to the drawings, the calendar 10 has the first sheet 11 and the second sheet 12 held together with a space therebetween to receive the slides 13 - 19.

Each of these slides 13 through 18 terminates at its upper end in a rounded portion integrally attached to the slide. The rounded portions provide convenient hand engaging portions and provide a visual index for positioning the slides. The rounded portions are shown aligned above the first sheet when the numbers in the rows 31 through 43 are displayed in the openings shown.

Each slide has a row of numbers on the front and another row on the back. The first slide 13 has the numbers 1,8, 15,22 and 29 on its first side directly opposite numbers 1, 8, 15 and 22 on its second side. The number 29 is spaced one space below the other numbers on this second side only.

The second slide 14 has the numbers 2, 9, 16 and 23 on the first side, directly opposite the numbers 2, 9, 16 and 23 on the opposite side, with the number 30 added one space below the number 23. The third slide 15 has the numbers 3, 10, 17 and 24 on its first side, directly opposite the numbers 3, 10, 17 and 24 on its second side with the number 31 one space below the other numbers on this second side only.

The fourth slide 16 has the numbers 4, 11, 18 and 25 one space above the corresponding numbers on the second side of the slide.

Likewise, the numbers 5, 12, 19 and 26 on one side of slide 17 are one space above the corresponding numbers on the opposite side of the slide.

The sixth slide 18 has the numbers 6, 13, 20 and 27 on one side, one space above the corresponding numbers 6, 13, 20 and 27 on the other side. The seventh slide 19 has the numbers 7, 14, 21 and 28 on one side, spaced one space above the corresponding numbers 7, 14, 21 and 28 on the other side.

The days 2–7 may fall in the first week of some months but in the second week of other months, while the numbers 25–30 may be in the last week of some months but in the second from the last week of other months. The first day of each month is always in the first week and the 30th of each month may be in the last week of the month. The 31st is always in the last week. When the 30th and 31st are in the last week of the month, the first day of that month is always on Saturday. For this reason, the second and third slides are not as long as the other slides. The friction between each vertical slide and the first and second sheets holds the slide in position.

Features of the calendar, regardless of how the front sheet and back sheet are fastened together, are that there are 42 see-through holes arranged in six horizontal rows, seven holes per row punched out into the front piece of the main housing unit, underlying corresponding holes to the first or top horizontal holes as well as to the last or bottom horizontal row punched or cut through the back piece of the horizontal main housing unit. The necessity of the holes through the back portion of the housing unit is to enable various vertically-numbered slides to be correctly positioned and lined up to and with specific see-through front holes. There are seven slides, each specifically numbered on both sides. By slipping or sliding these slides behind the holes of the front portion of the housing unit and lining up specific numbers to specific holes. Any calendar month consisting of 28 through 31 days can be derived.

Days of the week are permanently printed or labeled over the top of each vertical row of holes. Starting with the vertical rows, from left to right, Sunday is placed over the first row, Monday is placed over the second row, etc. through Saturday over the last vertical low. A single see-through hole is punched or cut into the upper or top portion of the back sheet of the main housing unit and a disc with each month printed on it is affixed to a pivot point to allow each month to show through the see-through hole as the wheel is rotated. This calendar need only be changed once each month and can be used for an indefinite period of time.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A calendar comprising a first sheet and a second sheet, means holding said first sheet and said second sheet together, seven vertical rows of six holes in each row in said first sheet, said holes in said vertical rows being disposed in six horizontal rows, each said vertical row having a day of the week printed above it, seven slides, each said slide positioned behind one of said vertical rows and sandwiched between said first and second sheets, said slides being frictionally held in position, said second sheet extending above said first sheet a substantial distance and an opening in the upper part of said second sheet and a disc having its center supported on said first sheet, said disc having the names of the months arranged on its front side, said disc being adapted to be rotated about its center to successively display the name of each month in said opening in said second sheet, said slides each terminating in an upper end having the rounded portion thereon, said rounded portion of said slides being aligned above the upper end of said first sheet when said numbers on one side of said slides are displayed in said openings in said first sheet, said rounded portions being adapted to be grasped by a hand to facilitate moving said slides, first said slide having numbers 1, 8, 15 and 22 on the one side thereof and numbers 1, 8, 15, 22 and 29 on the back side thereof, second said slide having numbers 2, 9, 16 and 23 on the first side thereof and number 1, 8, 15, 22 and 29 on the back side thereof, third said slide having numbers 3, 10, 17 and 24 on the first side thereof and numbers 3, 10, 17, 24 and 31 on the back side thereof, fourth said slide having numbers 4, 11, 18 and 25 on both sides thereof, fifth said slide having numbers 5, 12, 19 and 26 on both sides thereof, sixth said slide having numbers 6, 13, 20 and 27 on both sides thereof, seventh said slide having numbers 7, 14, 21 and 28 on both sides thereof.

* * * * *